US005839732A

United States Patent [19]

Guidi

[11] Patent Number: 5,839,732

[45] **Date of Patent: *Nov. 24, 1998**

[54] METHOD OF PLAYING A CASINO POKER GAME

[75] Inventor: Janice R. Guidi, Ventnor, N.J.

[73] Assignee: Select Video, Inc., Atlantic City, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 852,926

[22] Filed: May 8, 1997

[51] Int. Cl.[6] ..... A63F 1/00

[52] U.S. Cl. ..... 273/292

[58] Field of Search ..... 273/292, 274; 463/13

[56] References Cited

U.S. PATENT DOCUMENTS

| | | | |
|---|---|---|---|
| 4,836,553 | 6/1989 | Suttle et al. | 273/292 |
| 5,022,653 | 6/1991 | Suttle et al. | 273/292 |
| 5,288,081 | 2/1994 | Breeding | 273/292 |
| 5,395,120 | 3/1995 | Malek | 273/292 |
| 5,653,444 | 8/1997 | Dahl | 273/274 |

OTHER PUBLICATIONS

John Scarne, Scarne on Cards 246–279 (Rev. Augmented Ed. 1965).

Albert H. Morehead et al., The Complete New Hoyle 1–46 (Rev. Ed. 1991).

*Primary Examiner*—Benjamin H. Layno

*Attorney, Agent, or Firm*—Lerner, David, Littenberg, Krumholz & Mentlik

[57] ABSTRACT

A five card poker game in which a dealer deals himself and each player two cards face down, two cards face up and one card face down. Each of the players antes before the deal, and the dealer places an ante plus first and second bets. After the first three cards are dealt, each of the players may fold or may place a first bet equal to the ante. After the next card is dealt, each of the remaining players has a choice between folding or placing a second bet equal to twice the ante. The dealer may not fold. After the last card is dealt, the hands are compared, and if a player wins, he takes a predetermined percentage of the total bets and antes placed in the game.

10 Claims, 3 Drawing Sheets

METHOD OF PLAYING A CASINO POKER GAME

TECHNICAL FIELD

The present invention relates to a method of playing a card game using a standard 52-card deck, and more specifically to a method of playing poker wherein the players play against each other and against a dealer.

BACKGROUND OF THE INVENTION

Poker is a card game played with a standard or "poker" deck of 52 playing cards. A standard poker hand consists of exactly five cards, and is ranked according to a generally accepted table of card combinations as follows:

1. Royal Flush
2. Straight Flush
3. Four of a Kind
4. Full House
5. Flush
6. Straight
7. Three of a Kind
8. Two Pair
9. One Pair
10. High Card in Hand The object of each player in a poker game is to hold a hand having a higher ranking than any other player in the game.

Many different forms of poker have developed since it was first described in the early part of the last century. Those forms include variations on how the cards are dealt and variations on how bets are placed. In one form of poker called stud poker, each player must form a poker hand from the cards initially dealt to him. Several versions of stud poker exist. For example, in seven card stud poker, the five card poker hand is formed from a set of seven dealt cards; two cards of the set are not used. On the other hand, in five card stud poker, only five cards are dealt to each player, and the player must form his poker hand from those same five cards.

Another popular variation of poker is draw poker, wherein each player has the opportunity to exchange one or more cards to attempt to improve his poker hand. This game has also become popular in both five card and seven card versions.

In most forms of poker, wagering is an important element and contributes greatly to the interest and excitement of the game. For this reason, rules regarding dealing sequences and other aspects of the game have developed in part to enhance the wagering aspect of the game.

Typical rules for a five card stud poker game provide for each player to receive a face down or "hole" card and a face up card before a first betting interval. Thereafter, each of the three remaining cards are dealt face up, one at a time, with a betting interval after each of the cards is dealt. During each of the betting intervals, each player has the option of folding, in which case that player loses the bets previously placed, or remaining in the game, in which case the player must place an additional wager determined by the rules of the individual game. Players may also have an opportunity to "raise," or increase the additional wager required to stay in the game, during each betting interval. After the final betting interval and after all cards have been dealt, each player turns up his face down or "hole" card, and the player with the highest ranking poker hand wins all the wagers placed in the game.

In non-commercial or "parlor" versions of poker, the responsibility for dealing the cards is rotated among the players. There is normally no compensation to the "house" insofar as distribution of the winnings or "pot." Instead, the pot is distributed in its entirety to the winner. The dealer plays according to the same betting and dealing sequence as the other players. The dealer may be given certain advantages in a parlor game, such as being the last player to wager, and thus have the opportunity to observe the other players first.

In cardroom versions of the game, played in commercial establishments providing services to facilitate the game, the responsibility of dealing may be rotated as it is in the parlor version of the game. Alternatively, the "house" may provide a dealer who does not participate in the game. The house in a cardroom game receives compensation for the services it provides. That compensation may take the form of a percentage of the pot, a fixed fee per hand or a time-based fee.

In both parlor and cardroom versions of the game, each player plays against each of the other players. The appeal of the game to many players involves assessing the unseen hands of the other players, and deciding, based on that assessment, when to raise, hold or fold. The assessments are made using information gleaned from the other players' exposed cards, and from the other players' raise, hold and fold decisions. A player may also use other, less tangible, factors, such as the demeanor of the other players. The strategies involved, as well as the competitive nature of the game, have made poker an extremely popular wagering card game.

Poker is not, however, easily adaptable to casino play. In a typical casino card game such as blackjack, the house participates in the game and deals all hands. Such an arrangement is not readily adaptable to poker for several reasons. First, because the raise, hold or fold decisions of poker are complex and may not be reduced to simple formulae, the house "take" would depend on the skillfulness of the dealer/player/employee in making those decisions. Furthermore, because of the perceived high experience level of a casino dealer, players may assume their chances of winning against such a house employee to be poor.

Because of these problems, other methods have been used to adapt poker to the casino environment. In one example, disclosed in U.S. Pat. No. 4,836,553 to Suttle et al., each player plays against only the dealer. After the players ante, five cards are dealt face down to each player, and four cards face down and one face up to the dealer. A single hold/fold decision is made by each player after all cards are dealt; a fixed bet is placed by all remaining players and no raising is permitted. The dealer must remain in the game to the end; thus the dealer makes no hold or fold decision. In this version of the game, the dealer must have some predetermined poker hand rank, such as ace-king, for play to continue after the deal. Otherwise, remaining players receive even money on their ante and have their bets returned. If the dealer holds the minimum hand or better, each player beating the dealer receives at least even money, and bonus payouts are made depending on the poker rank of the hand held by each player.

The single hold or fold decision made by each player is made after all cards are dealt, and after the player has seen a single one of the dealer's five cards. No assessment of the hands of the other players need be made, because each player plays only against the dealer. As to information regarding the dealer's hand, the player knows only the identity of a single card in the dealer's hand. The player has no information gleaned from the dealer's hold/fold decisions, as none are made by the dealer.

Furthermore, because each player plays individually against only the dealer, the competitive nature of the poker game is greatly diminished. The players instead play only against the impersonal "house."

Winnings in a given game depend only on the poker rank of the individual players' hands. No reward is given for having the highest hand of the game or for making a correct "hold" decision after other players have folded. Further, winnings for an individual player are based on the game between that player and the dealer. In contrast, a player of cardroom or parlor versions of the game stand to win a "pot" accumulated from all the players at a table.

Another adaptation of a poker game for casino play is disclosed in U.S. Pat. No. 5,288,081 to Breeding. In that version of five card stud poker, payoffs are based solely on the rank of the poker hands held by the players, and the players play against neither the dealer nor each other. Each player initially places an ante and a two-part bet, and the dealer deals each player three cards face down and deals himself two community cards face down. Each player is then given an opportunity to retrieve the first part of his initial bet or to leave it at risk based on the value of the three cards in his hand and that player's perceived chances of attaining a predetermined minimum ranking hand. The dealer then turns over one of the community cards, and each player is then given an opportunity to retrieve the second part of his bet. The dealer then turns over the last card and the players are paid off according to the bets remaining in the game, and according to the ranking of the hand formed from each player's three cards and the community cards. A player must have the minimum ranking hand in order to receive any payout.

This casino version of poker eliminates the component of the game relating to judging the value of an opposing hand. Instead, a minimum predetermined rank poker hand, such as a pair of tens or better, must be made by the player in order to break even. The fold or hold decision is therefore based only on the player's perception of his chances of achieving the minimum fixed poker rank, rather that on the player's perception of his chances of beating a hand that is not completely known. No information regarding hands other than his own is considered by the player.

There is therefore a need for a casino poker game having a strategy element wherein players assess the rank of opposing hands both by observing exposed cards of the opposing hands and by observing the hold or fold decisions of the holders of the opposing hands. It is desirable for the players to perceive an advantage gained by the fact that the dealer is not permitted to hold or fold. It is further desirable that players in the casino poker game stand to win a pot comprising the antes and bets of all players at the table. The present invention addresses these needs.

SUMMARY OF THE INVENTION

The poker game of the present invention is played among up to six or more players and a dealer who is a "house" employee. The game is played with a standard 52-card "poker" deck. A winning hand is determined using standard poker rankings known in the art.

In a method of playing a game of poker according to the invention, each player first places a wager equal to an ante amount. All players place the same ante amount. The dealer places a wager equal to a total bet amount.

The dealer then deals one or more portions of the poker hand to each player and to the dealer. Each player is provided with a choice after each portion of the dealer hand is dealt: the player may fold, in which case that player's placed wagers are surrendered and that player leaves the game, or the player may wager an additional amount, in which case that player continues playing the game. The sum of the ante amount and the additional wagers each player must place to remain in the game to the end equals the total bet amount placed by the dealer at the beginning of the game.

The dealer then deals a final portion of the poker hand to each player and to the dealer to complete the poker hands. The hands of the dealer and the players are then examined in order to determine the holder of the hand having the highest poker rank among the players and the dealer. A predetermined percentage of the sum of all wagered amounts is then awarded to the holder of the highest hand. This predetermined percentage may, for example, be 90%, in which case the remaining 10% is withheld by the house.

Because the dealer is required to wager the full amount at the beginning of the game, and is not given an opportunity to fold, the dealer has no opportunity to use strategy in order to limit the dealer's losses where the dealer holds a bad hand. That limitation is perceived by players in the game as an advantage in their favor.

There may be two portions of the poker hand dealt before the final portion, resulting in the poker hand being dealt in three portions. The first portion of the poker hand may comprise three cards. The three cards may be dealt with the first and second cards face down and the third card face up. The second portion of the poker hand may be a single card dealt face up, and the final portion of the poker hand may be a single card dealt face down. The dealer may discard one card face down, or "burn" that card, before dealing each of the portions of the poker hand.

Where at least one of the cards in the poker hand is dealt face down, the players are permitted to look at the face down cards in their respective poker hands, while the dealer is not permitted to look at any face down cards. This further reinforces the notion that the dealer is at a disadvantage, and prevents collusion of the dealer with a player.

Where the hands are dealt in three portions, the amount wagered after the first portion of the hand has been dealt may be equal to the ante amount, and the amount wagered after the second portion of the hand has been dealt may be equal to twice the ante amount. Thus, in this arrangement, the total bet amount may equal four times the original ante amount.

DETAILED DESCRIPTION OF THE PREFERRED EMBODIMENTS

Figure 1:
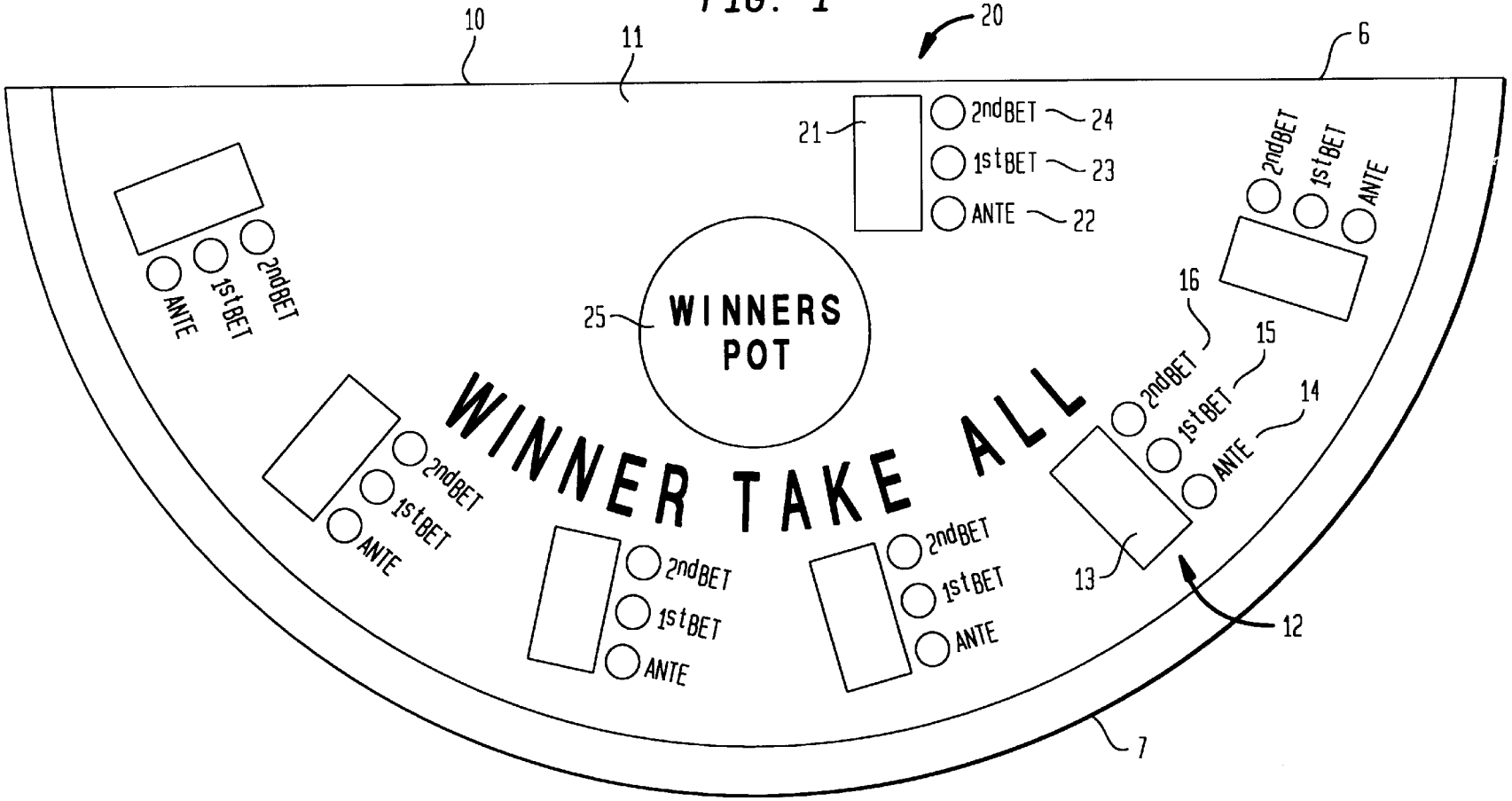
FIG. 1 is a schematic plan view of a table layout and apparatus used in playing the poker game of the present invention.

Referring to FIG. 1, apparatus for playing the poker game of the invention includes a table 10 having a cover 11 with indicia specifically configured for playing the game. The cover 11 may be felt or other material appropriate for card playing, as is known in the art. The table 10 and cover 11 may have a straight side 6 where the dealer is positioned and a curved side 7 around which the players are positioned.

The indicia on the table 11 include six player positions 12 to accommodate six players playing the game. More or fewer player positions may be incorporated into the cover 11. Six player positions is the preferred number because that number is easily manageable by the dealer, while offering a sizable pot to be awarded the winner.

Each player position includes a card area 13 where the cards of the respective player's hand are dealt. Each player position further comprises three labeled wager positions. Wager position 14 is for placing an ante bet, wager position 15 is for placing a first bet, and wager position 16 is for placing a second bet. The wager positions are clearly marked and are separated so the dealer may easily determine that each player has properly placed bets, and may quickly evaluate which players have folded. The wagering positions include a circular or other appropriately shaped region configured to receive a wagering indicator such as a casino chip. On the straight side 6 of the table 10, a dealer's position 20 comprises a card area 21 and three wagering positions. The wagering positions are similar to those of the players, including an ante position 22, a first bet position 23 and a second bet position 24.

The playing table 10 also includes a winner's pot position 25 near the center of the table for receiving the players' wagers for distribution to the winner at the end of the game.

The poker game of the invention is played with a standard 52-card deck, commonly called a "poker" deck. No jokers are used in the deck. In a preferred embodiment of the game, a maximum of six players are permitted to play. The object of the game is to form the highest poker hand at the table from the five cards dealt.

At the beginning of each game, the dealer shuffles a single deck of cards and places the cards in a dealing shoe (not shown) from which the cards will be dealt. The dealer participates as a player in each game played.

Figure 2:
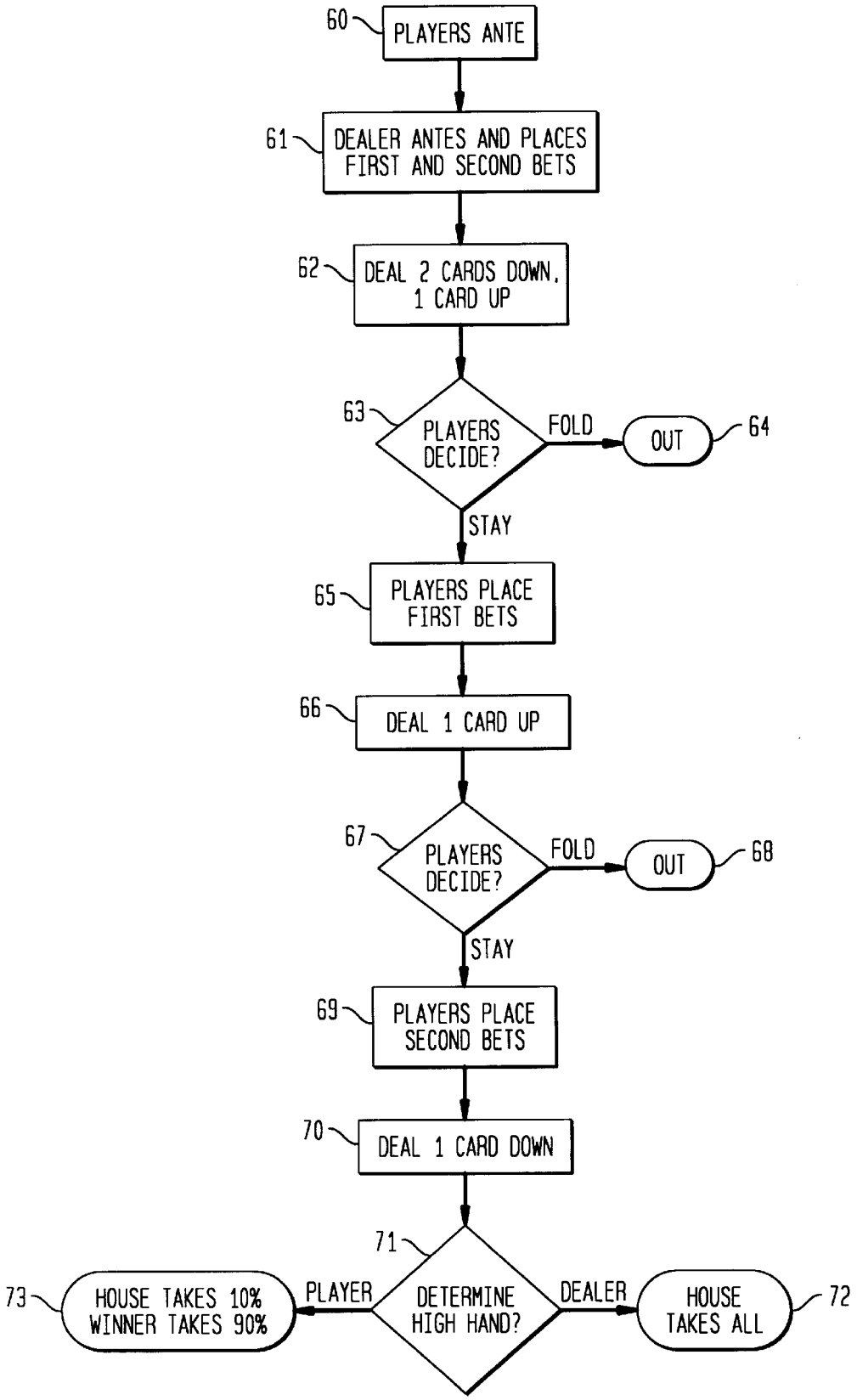
FIG. 2 is a block diagram showing a sequence of play in accordance with another method of playing the game of the present invention.

After the dealer shuffles, each player places an ante in the ante position 14 of that player's respective player position 12. In the preferred embodiment of the invention, all antes and bets are represented by chips of various color denominations which are placed in a circular space in the ante position. All bets and antes are predetermined amounts established by the rules of the game. Each of the players places ante and bet amounts identical to those of his or her fellow players. The step of placing antes is represented by block 60 of the block diagram of FIG. 2.

The dealer then places an ante, first bet and second bet in ante position 22, first bet position 23 and second bet position 24, respectively, of the dealer's position 20. The dealer's ante and bets are represented by block 61 of the block diagram. Thus, before the cards are dealt and before the game begins, the dealer has placed all bets made by the house in the game. The dealer is not permitted to recall those bets. This feature of the game gives each of the players an advantage over the dealer in playing the game, because each player is permitted to fold where it appears that his or her hand will not win.

The dealer then discards or "burns" the first card of the deck face down into a discard rack (not shown). This standard procedure assures the integrity of the deal. The dealer next deals a first portion of a poker hand to each player and to himself. In a preferred method for playing the poker game, the first portion comprises two cards dealt face down, followed by a third card face up, as represented in block 62. The cards are dealt in rotation, as is known in the art, dealing a single card to each player and to the dealer, followed by a second card to each player and the dealer, followed by a third card. At this point, the players are permitted to examine the face down cards in their own hands. Based on the perceived strength of the hand, each of the players decides whether to fold or stay, as represented in decision block 63. If a player decides to fold, he is out of the game, as represented by block 64, and he forfeits his ante which is placed in the winner's pot 25 (FIG. 1) to be combined with the remaining bets before distributing the winnings. The folding players' cards are relinquished and placed in the discard rack. In contrast to the players, the dealer is not permitted to look at his face down cards and is not permitted to fold at any point in the game. In other words, the dealer is required to stay in the game regardless of the strength of his hand.

Those players remaining in the game place their first bets in their respective first bet positions 15 (block 65). The dealer "burns" another card face down into the discard rack, and then deals a second portion of each player's poker hand; in a preferred embodiment, the second portion is a single additional card face up, as represented by block 66. The players again make a decision, represented by block 67, whether to fold (block 68) or stay in the game. The decision of each player is now based on an assessment of the four cards in that player's hand, as well as an assessment of the hands of the other players, which in turn is based on factors such as whether any of the players has folded, the exposed cards of the other players, and possibly the other players' demeanor.

As after the first betting round, the folding players relinquish their hands, which are placed in the discard rack, and relinquish their antes and first bets, which are collected and placed in the winner's pot.

The players staying in the game place second bets in their respective second bet positions 16, as represented by block 69. At this point, each player has wagered a total bet amount equal to the total bet amount wagered by the dealer.

The dealer then "burns" another card face down in the discard rack, and deals a final portion of the hand to each remaining player. In a preferred embodiment, the final portion comprises one card dealt face down to each remaining player and to the dealer, represented by block 70. Each player and the dealer now hold complete five-card poker hands.

Beginning right to left, the dealer turns the face down cards in each hand face up, then turns his own cards face up. All cards are now exposed, and the rank of each hand may be determined, as represented by decision block 71 of the block diagram.

If the dealer's hand has the highest poker rank, the house takes all ante, first bets, second bets and the contents of the winner's pot, as represented by block 72. If one of the players holds the hand with the highest poker rank, a winner lammer or marker is placed in front of that hand. All antes, first bets and second bets are then collected and placed in the winner's pot. The pot is counted and a predetermined percentage or house cut will be collected from the total. In a currently preferred embodiment, the predetermined percentage is 10%. The predetermined percentage is selected to yield a desired gross profit from the game. The winning player then receives the amount remaining in the pot, as is shown in block 73. The winner lammer is then removed, and the cards are collected and placed in the discard rack, together with the unused cards from the dealing shoe and the relinquished cards.

From a player's point of view, the poker game of the invention involves many of the strategies involved in playing cardroom or "parlor" versions of poker. The player evaluates the strength of multiple opposing hands and compares those hands to his or her own hand. Those evaluations are based on the identity of the face-up cards of the opposing players' hands, in conjunction with the opposing players' hold or fold decisions, and even the opposing players' demeanors. The last two sources of information are not available to a player of a casino poker game in which players play only against the dealer or the house. Because the casino dealer is not permitted to make hold or fold decisions, he or she conveys no information about his or her hand to the players.

The poker game of the invention includes several other important characteristics of parlor or cardroom poker that are not typically found in casino versions of the game. There is no minimum qualifying hand of the dealer in the poker game of the invention. Thus, the game is played to completion no matter what hand the dealer holds. This increases the pace of play by eliminating the numerous "dead" hands in which the dealer has less than the minimum ranking hand. In the game of the present invention, one of the participants or the dealer always takes the pot.

Furthermore, because the payout is based on the highest hand at the table rather than on probabilities attached to the various poker ranks, it is possible to win the entire pot with a mediocre or even a poor hand if the other hands at the table are of lesser rank. This feature increases interest and drama in the game by providing the potential of a large payout to the holder of a nominally poor hand.

By pooling the bets of all the individual players into a single winner's pot, the perceived potential for a large win in a single game is significantly increased over a game in which payouts are apportioned according to the probabilities attached to the individual poker hands. One of the players or the dealer in each game wins an entire pot regardless of the rank of the high hand.

While maintaining many of the attributes of parlor or cardroom poker, the game of the invention is specifically adapted to be played in a casino where the dealer is a house employee. No strategic decisions are made by the dealer, and the house profit on a particular game is not influenced by the skill of the dealer. Further, the house's inability to fold decreases the chances of an outcome wherein the house wins the entire winner's pot. Players perceive this as a significant advantage, which makes the game more attractive to casino players.

While players may hold or fold during each betting round, there is no raising in the poker game of the invention. Raising is an element of most parlor and cardroom games in which a player may increase the wager required to remain in the game. In the context of casino poker, however, the element of raising greatly complicates the betting rounds by varying the bets placed in each round from game to game. The element of raising also tends to make a game significantly less friendly, which may present a problem in casino settings where groups arriving together often play at common tables. For these reasons, the poker game of the present invention does not incorporate raising.

Figure 3:
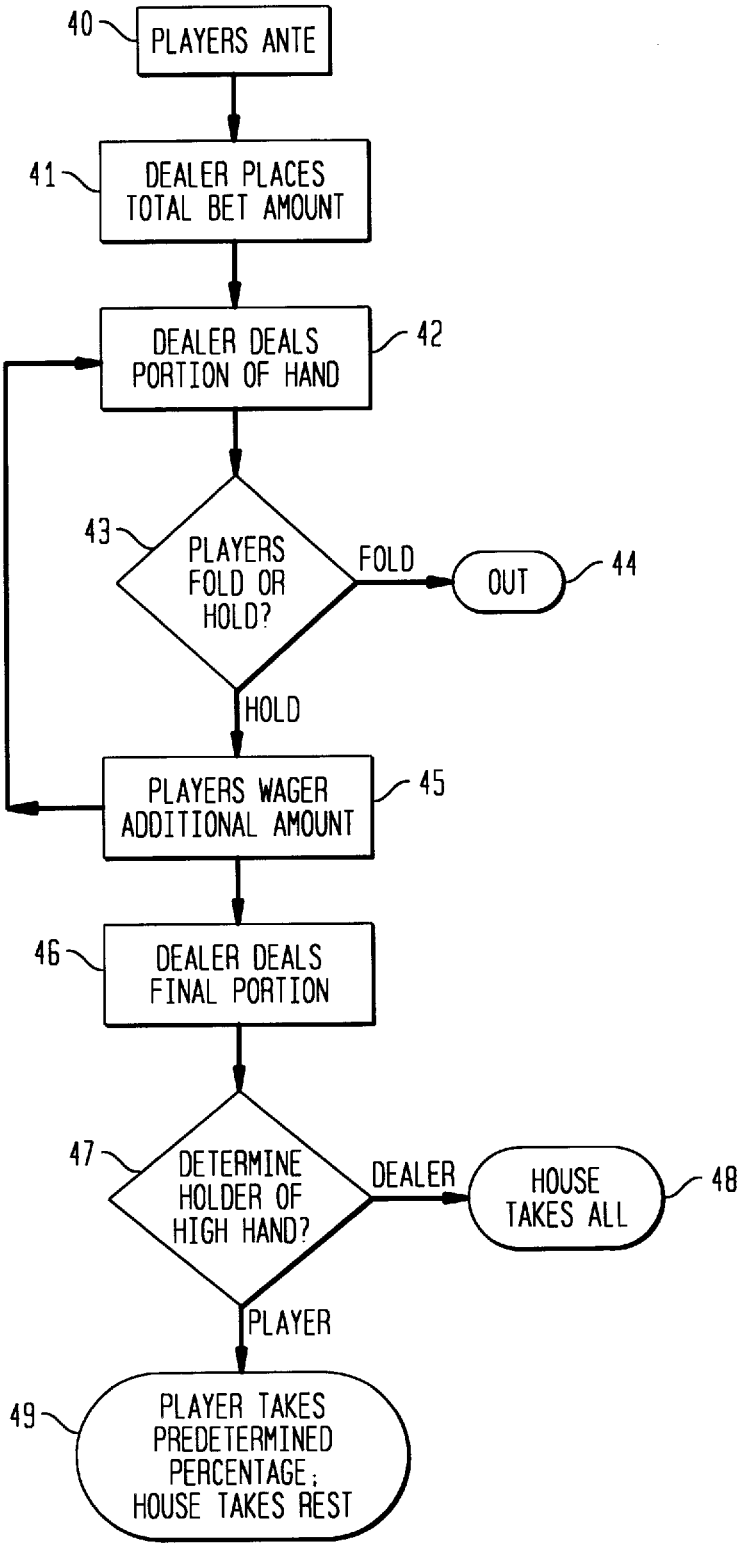
FIG. 3 is a block diagram showing a sequence of play in accordance with another method of playing the game of the present invention.

Variations in the number of cards dealt, the number of cards dealt face up and the timing and amount of the wagers may be incorporated into the poker game without departing from the scope of the invention. For example, the dealer may deal a single card at a time, with the players wagering after each of the cards is dealt. Blocks 42–45 of FIG. 3 show a playing sequence in which the dealer deals a portion of the hand that may consist of between one and four cards, followed by the players decision to fold or hold, followed by the players wagering an additional amount. These steps are repeated a predetermined number of times. The dealer then deals a final portion of the hand, represented by block 46, completing the poker hand of each player and the dealer.

In this embodiment, as in the previously described example, the initial wager placed by the dealer is equal to the total of the ante amount and all the wagers to be placed by the players remaining in the game to the end. Because the dealer is not permitted to retrieve his wages, this initial placement of the bet by the dealer clearly conveys to the players that the dealer may not fold, and that the players therefore have a strategic advantage over the dealer.

Additionally, the percentage of a player's winnings taken by the house may be varied from the 10% used in the above example, and is required only to be equal to a predetermined percentage, as shown in block 49.

As will readily be appreciated, numerous variations and combinations of the features discussed above can be utilized. For example, an additional hold or fold decision and an additional wager for the remaining players may be required after the dealer deals the final portion of the poker hands, represented in block 70. As this and other numerous variations and combinations of the features discussed above may be employed without departing from the present invention, the foregoing description of the preferred embodiment should be taken by way of illustration, rather than by way of limitation of the features discussed above.

We claim:

1. A method of playing a game of poker among one or more players and a dealer, comprising the steps of:

(a) each player placing a wager equal to an ante amount;

(b) the dealer placing a wager equal to a total bet amount;

(c) the dealer dealing one or more portions of a poker hand to each player and to the dealer;

(d) providing each player with a choice, after each portion of said poker hand has been dealt, between folding, in which case said wagers of that player are surrendered and that player leaves the game, and wagering an additional amount, in which case that player continues playing the game, wherein a sum of said ante amount and said additional amounts for each player equals said total bet amount;

(e) the dealer dealing a final portion of a poker hand to each player continuing to play the game and to the dealer to complete the poker hands; and (f) determining which of said hands has the highest poker rank, and if said hand is held by a player, awarding a predetermined percentage of a sum of said ante amounts and said additional amounts wagered to said player.

2. A method of playing a game of poker as claimed in claim 1, wherein said predetermined percentage is 90%.

3. A method of playing a poker game as claimed in claim 1, wherein two portions of said poker hand are dealt before said final portion.

4. A method of playing a game of poker as claimed in claim 1, wherein a first one of said portions of said poker hand includes 3 cards.

5. A method of playing a game of poker as claimed in claim 4, wherein said first portion of said poker hand is dealt with a first card and a second card face down and a third card face up.

6. A method of playing a game of poker as claimed in claim 5, wherein a second one of said portions of said poker hand includes a single card dealt face up and said final portion of said poker hand includes a single card dealt face down.

7. A method of playing a game of poker as claimed in claim 1, wherein at least one card in each said poker hand is dealt face down, the players are permitted to look at said face-down cards in their respective poker hands, and the dealer is not permitted to look at said face-down cards in the dealer's poker hand.

8. A method of playing a game of poker as claimed in claim 1, wherein the dealer discards one card face down before dealing each of the portions of said poker hand.

9. A method of playing a game of poker as claimed in claim 1, wherein two additional amounts are wagered by each player, the first additional amount is equal to the ante amount and the second bet amount is equal to twice the ante amount.

10. A method of playing a game of poker among one or more players and a dealer, comprising:

(a) each player placing an ante equal to an ante amount;

(b) the dealer placing a wager equal to four times the ante amount;

(c) the dealer dealing first and second cards of a poker hand face down and a third card of said poker hand face up to each player and to the dealer;

(d) providing each player with a choice between leaving the game, in which case that player forfeits that player's ante, and placing a first wager equal to the ante amount, in which case that player continues playing the game;

(e) the dealer dealing a fourth card of said poker hand face up to each remaining player and to the dealer;

(f) providing each player with a choice between leaving the game, in which case that player forfeits that player's ante and first wager, and placing a second wager equal to twice the ante amount, in which case that player continues playing the game;

(g) the dealer dealing a fifth card of said poker hand face down to each player and to the dealer to complete the poker hands; and (h) determining which of said hands has the highest poker rank, and if said hand is held by a player, awarding 90% of the total antes and wagers to said player.

* * * * *

UNITED STATES PATENT AND TRADEMARK OFFICE

CERTIFICATE OF CORRECTION

PATENT NO. : 5,839,732

DATED : November 24, 1998

INVENTOR(S) : Guidi

It is certified that error appears in the above-identified patent and that said Letters Patent is hereby corrected as shown below:

Title page, item [75], after "Ventnor" insert --City--.

Signed and Sealed this

Thirtieth Day of March, 1999

*Attest:*

*Attesting Officer*

Q. TODD DICKINSON

*Acting Commissioner of Patents and Trademarks*